United States Patent [19]

Coleman, IV

[11] Patent Number: 4,619,621

[45] Date of Patent: Oct. 28, 1986

[54] SURF RIDING AIR BAG

[76] Inventor: Harry E. Coleman, IV, P.O. Box #26, Arch Cape, Oreg. 97102

[21] Appl. No.: 701,777

[22] Filed: Feb. 14, 1985

Related U.S. Application Data

[63] Continuation-in-part of Ser. No. 492,672, May 9, 1983, abandoned.

[51] Int. Cl.[4] ..... A63C 15/00

[52] U.S. Cl. ..... 441/66; 441/129; 383/3; 383/6; 383/71

[58] Field of Search ..... 441/129, 65, 66, 88, 441/40; 383/3, 6, 17, 71, 70

[56] References Cited

U.S. PATENT DOCUMENTS

| | | | |
|---|---|---|---|
| 1,461,911 | 7/1923 | Jordahn | 441/129 |
| 1,634,314 | 7/1927 | Ayvad | 441/88 |
| 2,920,670 | 1/1960 | Mohlmann | 383/71 |

FOREIGN PATENT DOCUMENTS

| | | | |
|---|---|---|---|
| 480834 | 2/1952 | Canada | 383/17 |

OTHER PUBLICATIONS

"Surfers Hope Bags Ride Wave", *The Daily Astorian,* Ben Silverman.

*Primary Examiner*—Sherman D. Basinger
*Attorney, Agent, or Firm*—Eugene M. Eckelman

[57] ABSTRACT

A flexible inflatable container is closed at one end and open at its other end. A closure strap is secured to the bag adjacent the open end and is arranged to be wrapped around and close this open end after inflating the bag. This closure strap is associated with another strip of material secured to the bag for forming a handle at this end of the bag. The other end of the bag has a base strip secured peripherally around the bag and has flexible strips secured thereto to form handles at this end of the bag. The bag is sufficiently elongated from end to end so as to carry a person lying crosswise thereon for riding a wave in the surf.

3 Claims, 3 Drawing Figures

SURF RIDING AIR BAG

REFERENCE TO PRIOR APPLICATIONS

This application is a continuation-in-part of application Ser. No. 492,672 filed May 9, 1983 for Surf Riding Air Bag and now abandoned.

FIELD OF THE INVENTION

This invention relates to a surf riding air bag capable of being inflated such that a person can float thereon.

BACKGROUND OF THE INVENTION

Many inflatable devices have heretofore been provided which are designed to support a person in the water. Such devices are designed primarily for floating in swimming pools, lakes, or rivers. An example of such a float is shown in U.S. Pat. No. 1,461,911 wherein a person is arranged to lie lengthwise thereon and either float in the water or be towed behind a boat or the like. This type of float has an inherent disadvantage, as do other floats, namely, it was not designed for surf or rough water riding and furthermore has no convenient means for inflation.

SUMMARY OF THE INVENTION

According to the present invention and forming a primary objective thereof, a flotation device is provided which is designed specifically for riding the waves of a surf or other rough water and also has a particular design providing for easy and practically instant inflation.

Another object is to provide a flotation device which is designed to receive a person crosswise thereon and also designed with a novel arrangement of handles and wrap around feature which allows a person to stay with the device in rough water.

In carrying out the objectives of the invention, there is provided a flexible inflatable container constructed of a body portion having one closed end and an opposite end having an enlarged opening but capable of being closed by closure strap means. Such closure strap means also includes a handle as a part thereof and handle means are further provided adjacent the opposite end of the container whereby to provide grips on opposite sides of the person riding the device.

The invention will be better understood and additional objects and advantages will become apparent from the following description taken in connection with the accompanying drawings.

DETAILED DESCRIPTION OF A PREFERRED EMBODIMENT

Figure 1:
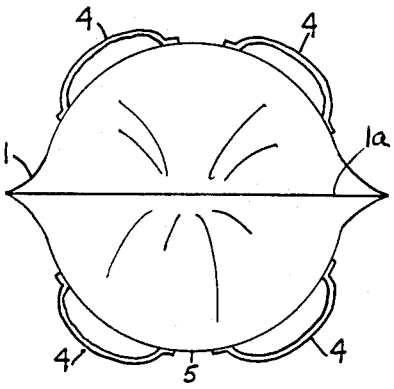
FIG. 1 is an end elevational view of the present surf riding air bag in inflated condition.
Figure 2:
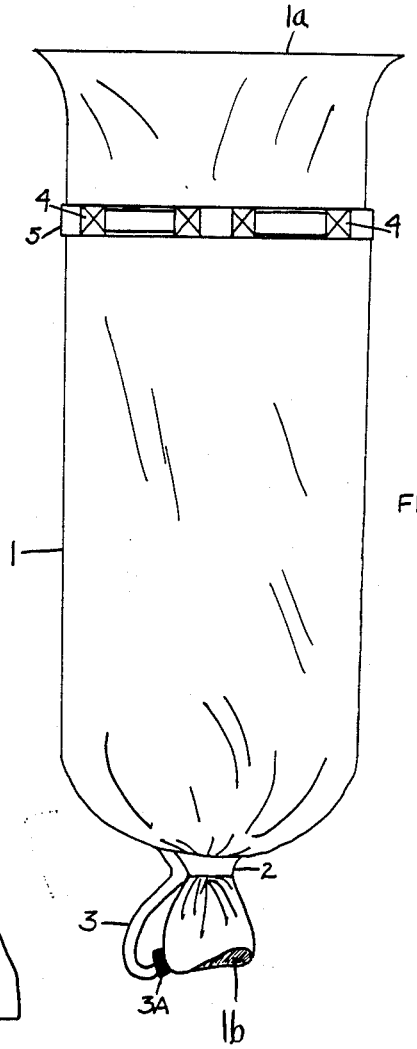
FIG. 2 is a longitudinal elevational view of the bag as inflated.
Figure 3:
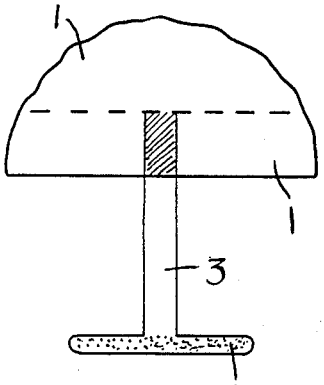
FIG. 3 is a fragmentary elevational view of the open end of the bag as released in open position.

Referring now more particularly to the drawings, the invention comprises an elongated bag or container 1 having a sealed end 1*a* and an open end 1*b*. An important feature of this bag is that it is made of a cotton/polyester or other suitable lightweight and substantially air tight flexible material which is capable of serving as a flotation device. Also, the open end 1*b* comprises a full end opening whereby with such large opening and the lightweight flexible material, the bag is readily filled by holding it up in the wind or running into the wind.

It has been found that a cotton/polyester material comprises a preferred material in that when the bag becomes wet, the cotton fibers swell around the polyester and create an excellent air seal.

The open end 1*b* of the bag is arranged to be sealed by a Velcro strip 2 which is secured crosswise on one end of a strap 3 in turn secured at its other end on an end portion of the bag in longitudinal extension of the latter. In closing the bag, an end portion thereof is bunched together and the strip 3 looped back and the Velcro strip wrapped around the bag to close it. Strip 3 is of sufficient length such that a loop can be left therein between the secured portion 2 and the end of the bag. This loop provides a handle as will be more apparent hereinafter.

The bag is provided at the end opposite from its open end with an encircling band or strip 5 secured thereto such as by stitching. This band is substantially parallel with the closed end of the bag and this band has loops or handles 4 secured thereto in the area of the bag, also such as by stitching.

In use as a flotation device, a person lies crosswise on the inflated bag and is capable of obtaining a firm grip of the bag by the oppositely located handles 3 and 4. Preferably, at least four of the handles 4 are provided in spaced relation around the bag for selected grasping by the person riding the bag. The bag is sufficiently elongated to allow a person to lie crosswise thereon and also to allow the bag to wrap partially around the person so that the person's body is substantially firmly locked to the bag. The bag, being quite flexible, will, however, allow a person to remove himself or herself readily therefrom. The bag may deflate slightly as it is being used but it is readily re-inflated merely by removing the strip 2 and either holding the bag up to the wind or running with the bag.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A surf riding air bag comprising a flexible inflatable container having a body portion closed at one end and open at its other end to form a filler opening, said opening being substantially the full size of the bag to provide an enlarged filler opening, said inflatable container being constructed of a cotton polyester type of material so as to be of light weight and readily inflated by wetting it and holding it up in the air with the enlarged filler opening catching air currents, closure strap means secured to said bag adjacent the open end of the latter for wrapping around and closing said filler opening after inflating the bag, said bag being sufficiently elongated from end to end to carry a person lying crosswise thereon for riding a wave in the surf and to partially wrap around the person lying thereon, and handle means adjacent each end of said bag for obtaining a riding hold on the bag by a person lying crosswise thereon.

2. The surf riding air bag of claim 1 wherein said strap means includes a first strip secured at one end to said bag, and a second strip of material secured at right angles to said first strip, said second strip being of a construction capable of securing itself around the open end of the bag for closing the said open end, said first strip being looped between its secured end and said second strip when the latter is secured around the open end of the bag to form one of said handle means.

3. The surf riding air bag of claim 1 wherein said handle means adjacent the closed end of the bag comprises a base strip secured peripherally to and around said bag in substantially parallel relation with said closed end, and flexible strips secured to said base strip in the area of said bag to form handles on said bag.

* * * * *